US008353261B2

(12) United States Patent
Syler

(10) Patent No.: US 8,353,261 B2
(45) Date of Patent: Jan. 15, 2013

(54) WATER HEATER BASE

(75) Inventor: Rodney R. Syler, Franklin, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 43 days.

(21) Appl. No.: 12/834,516

(22) Filed: Jul. 12, 2010

(65) Prior Publication Data

US 2010/0275444 A1 Nov. 4, 2010

Related U.S. Application Data

(62) Division of application No. 11/763,594, filed on Jun. 15, 2007, now Pat. No. 7,765,959.

(51) Int. Cl.
*F24H 9/06* (2006.01)

(52) U.S. Cl. ..... 122/19.2; 29/890.03

(58) Field of Classification Search ..... 122/19.2; 29/890.03, 890.031, 890.038, 890.046, 890.047
See application file for complete search history.

(56) References Cited

U.S. PATENT DOCUMENTS

| | | | | |
|---|---|---|---|---|
| 1,694,689 | A * | 12/1928 | Pritchard | 72/105 |
| 2,299,053 | A | 10/1942 | Ferris | |
| 2,325,497 | A | 7/1943 | Floyd | |
| 4,039,098 | A | 8/1977 | Stilts | |
| 5,115,767 | A | 5/1992 | West et al. | |
| 5,154,140 | A | 10/1992 | Windon | |
| 5,178,351 | A | 1/1993 | Lesage | |
| 5,180,077 | A | 1/1993 | Lewis | |
| 5,575,402 | A | 11/1996 | Botsolas | |
| 5,836,554 | A | 11/1998 | Lesage | |
| 5,924,392 | A | 7/1999 | Hall | |
| 6,109,216 | A | 8/2000 | Reynolds et al. | |
| 6,267,261 | B1 | 7/2001 | Lesage | |
| 6,295,952 | B1 | 10/2001 | Reynolds et al. | |
| 6,588,378 | B1 | 7/2003 | Henderson et al. | |
| 6,666,174 | B1 * | 12/2003 | Lesage | 122/19.2 |
| 6,807,925 | B1 * | 10/2004 | Lesage | 122/14.1 |
| 2005/0229870 | A1 * | 10/2005 | Doss et al. | 122/13.01 |
| 2008/0308689 | A1 | 12/2008 | Syler | |

FOREIGN PATENT DOCUMENTS

| | | |
|---|---|---|
| DE | 1258576 | 1/1968 |
| DE | 29504173 | 4/1995 |
| EP | 0797055 | 9/1997 |
| FR | 1564748 | 4/1969 |

OTHER PUBLICATIONS

PCT/US2008/057314 International Search Report and Written Opinion dated Jul. 23, 2008 (14 pages).

* cited by examiner

*Primary Examiner* — Gregory A Wilson
(74) *Attorney, Agent, or Firm* — Michael Best & Friedrich LLP

(57) ABSTRACT

A method of making a circular support base for a water heater in which a sheet of material having two ends is formed with corrugations such that the corrugations are progressively more pronounced towards one longitudinal edge thereby creating a generally circular shape out of the formerly straight sheet material, the two ends are connected to form an unbroken circular shape, the corrugated material is shaped to form a lip at an inner circumferential region, and the circular lip intersects with an outer circumferential region of the support base to form a circular trough for supporting and positioning a water tank of the water heater.

17 Claims, 4 Drawing Sheets

WATER HEATER BASE

RELATED APPLICATIONS

This application is a divisional of co-pending U.S. patent application Ser. No. 11/763,594 filed on Jun. 15, 2007, the entire content of which is incorporated herein by reference.

BACKGROUND

The present invention relates to a water heater support base for supporting components of a water heater in their proper position and in a manner that elevates an outer jacket of the water heater and still provides sufficient space for insulation between a water tank and the outer jacket.

As conventionally constructed, a water heater typically has a water tank adapted to hold a quantity of water to be heated, an outer jacket outwardly circumscribing the vertical water tank sidewall portion and forming an annular insulation space between the jacket and the water tank. A quantity of insulation is typically disposed in this annular space. A bottom end of the water tank and jacket is typically placed into a bottom pan structure and suitably secured to the pan. The bottom pan must be both durable and structurally sound to support and properly position the water heater components.

A common method of placing insulation in the annular space surrounding the water tank, after a bottom portion of the water tank and outer jacket structure are secured within the bottom pan, is to simply inject liquid foam insulation into the annular space and let the injected foam cure after injection. One of the functions of the bottom pan is to hold the base of the water tank and outer jacket in position during the foam injection and curing process, to prevent the water tank from wandering around within the outer jacket as the foam expands.

SUMMARY

In one embodiment of the invention, a water heater is provided with a support base for supporting a water tank and an outer jacket surrounding the water tank. The support base comprises a circular lip coupled to an angled middle portion for supporting the water tank at a junction of the lip and the middle portion. The junction is preferably formed as a circular trough where the lip is coupled to the angled middle portion which projects upwardly from the lip in a non-vertical direction. The trough provides a structurally robust platform for positioning and supporting the water tank. The angled middle portion is coupled at its upper end to a top portion extending in a generally vertical direction from the upper end of the angled middle portion such that the top portion provides support for the outer jacket. The angled middle portion and the top portion intersect to form a support surface for the outer jacket such that the outer jacket is elevated vertically above the level of the trough. The support base may be formed from a flat strip of metal that is corrugated or crimped into a shape that can be readily formed into a circular jacket base.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
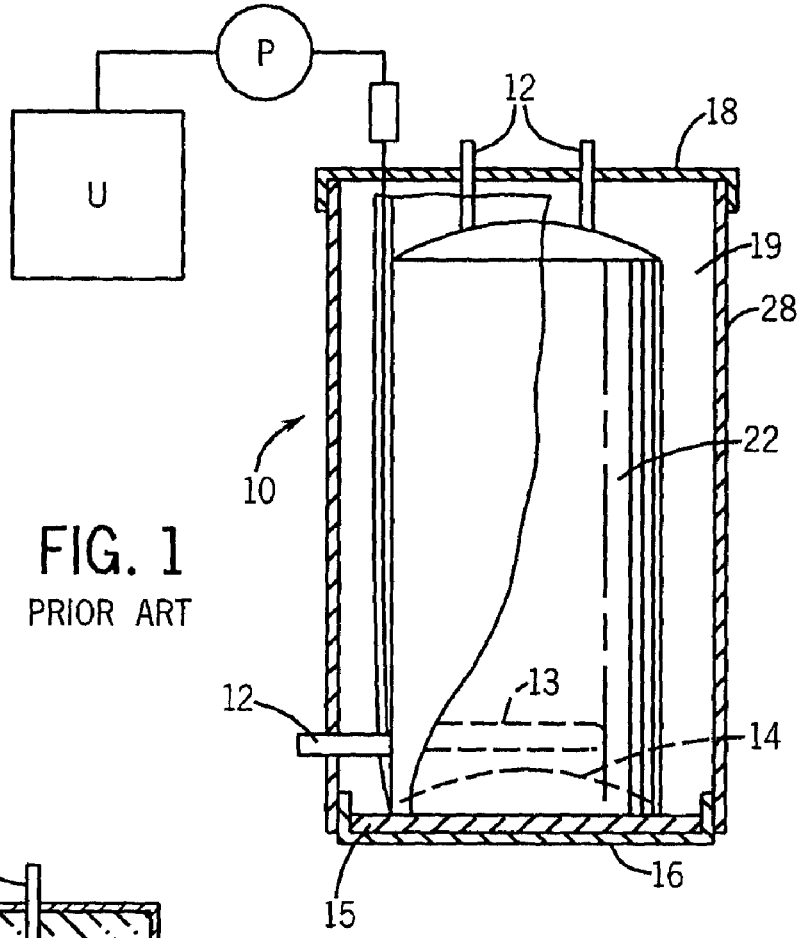
FIG. 1 PRIOR ART
FIG. 1 is a simplified fragmented section view showing a prior art construction of a water heater utilizing a typical prior art support base.

Referring now to the drawings and, more particularly, to FIG. 1, there is shown generally at 10 a basic prior art construction of a water heater. The water heater 10 comprises a water tank 22 in which water is heated by a heating device, shown in dashed outline at 13, such as electric resistive elements in the a lower portion of the interior of the water tank 22, as is well known in the art. The water tank 22 is provided with pipe fittings 12 or other fittings such as 12', which lead to the internal resistive elements 13. The water tank 22 is typically provided with a dome shape bottom wall 14 and the water tank sits on an insulating support base 15, which has formed in it a circular trough in which the bottom edge of the water tank 22 sits. The insulating support base 15 is positioned as a flat layer in a pan 16 about which is secured an outer jacket 28. A top cover 18 is secured over a top end of the outer jacket 28. The outer jacket 28 is provided with a side wall that is spaced apart from an outer wall of the water tank 22 to provide an insulating space 19. As foam insulation expands within the insulating space 19, the tank 22 is prevented from wandering within the jacket 28 by the insulating base 15. A similar construction is illustrated in U.S. Pat. No. 5,154,140.

Figure 2:
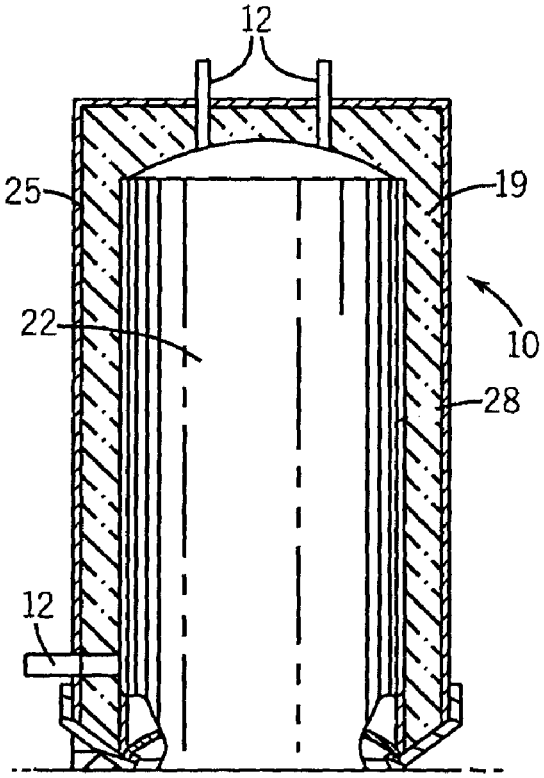
FIG. 2 is a section view showing a water heater utilizing a support base of the present invention and illustrating insulation in relation to an inner water tank and a surrounding outer jacket for the water heater.

In FIG. 2, a water heater 10 is shown in a structure that incorporates the present invention. A ring-shaped support base 30 supports the water tank 22 and centers it in the jacket 28 the foam insulation injection and curing process.

Figure 3:
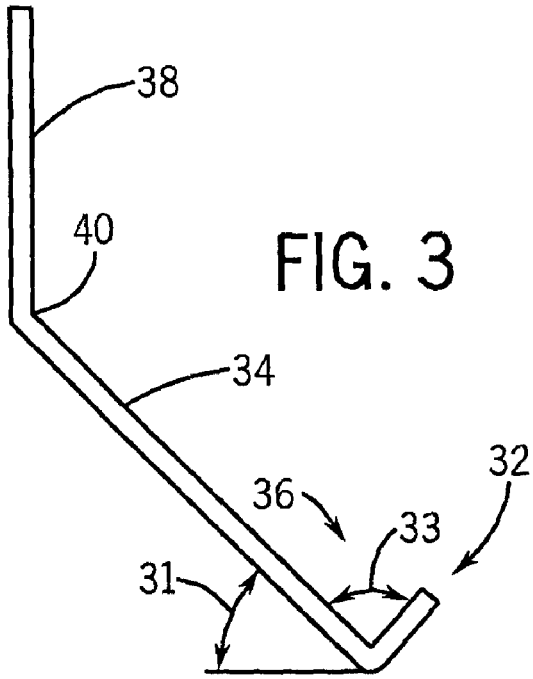
FIG. 3 is a section view showing the construction of a preferred embodiment of a support base for supporting a water heater in accordance with the present invention.
Figure 4:
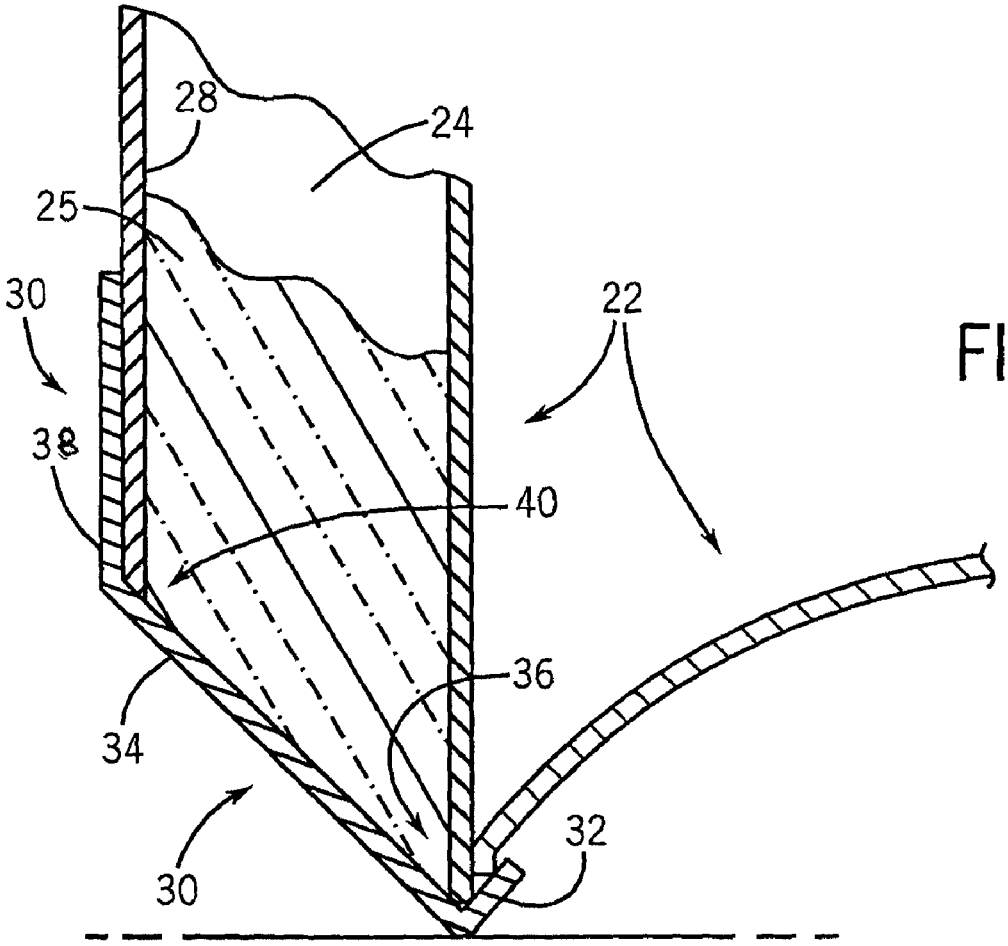
FIG. 4 is a section view of the support base of FIG. 3 with certain other water heater components also shown in section view.

Referring now to FIGS. 3 and 4 there is shown a cross-section of the one construction of the support base 30. It should be understood that a range of dimensions and angles can be utilized in the practice of the invention. The specific selection of surface size, angles and dimensions is a matter of choice for those skilled in the art. In the embodiment shown, the support base 30 is formed in three separate sections, as viewed in a cross-section. These three sections comprise a lip 32, an angled middle portion 34 and a top portion 38. To form these three sections, a single piece of metal material can be transformed into the three sections using various metal shaping techniques. It is also possible to form the support base 30 by coupling three separate structures. Alternatively, non-metallic materials can be utilized such as plastic. Various other non-metallic materials and means of construction may also be utilized.

Referring again to FIGS. 3 and 4, in the embodiment shown the angled middle portion 34 constitutes the largest cross-section and greatest surface area of the three sections. The angle 31 of this middle portion 34 in comparison to a surface or floor on which it will stand may be, for example, 45 degrees or another angle suitable for a particular construction. The angled middle portion 34 can be either straight or curved when viewed in cross-section.

The angled middle portion 34 is coupled to or formed to be integral with the lip 32 at its lower end and the top portion or vertical portion 38 at its upper end. The lip 32 is typically coupled to the angled middle portion 34 at something less than a 90 degree angle (for example, 85 degrees) between the two parts as shown at 33 in FIG. 3. At this junction or intersection between the lip 32 and the angled middle portion 34, there is formed a trough 36 that extends around the circumference of the support base 30 to define a trough circle. The diameter of the trough circle is the same as the diameter of the bottom edge of the water tank 22 so that the bottom edge of the water tank 22 fits snugly within the trough 36. It can be readily appreciated that this trough 36 provides a suitable platform and positioning device for the water tank 22.

At its other end, the angled middle portion 34 is coupled to or integral with the top portion 38. In the embodiment shown, the top portion 38 is generally angled in a vertical or nearly vertical direction. Consequently, the angle between the top portion 38 and the angled middle portion 34 will generally be more than 90 degrees, and typically about 135 degrees. Again, this angle can be varied over a range.

At an intersection or junction between the top portion 38 and the angled middle portion 34, there is provided a support surface 40 that supports a lower end or lower edge of the outer jacket 28. It can be readily appreciated that this support surface 40 is elevated a distance off the floor equal to the rise 100 of the triangle. Compared to prior art water heater constructions in which the jacket extends all the way to the floor, the present invention enables use of a shorter outer length jacket and consequently saves an amount of jacket material equal to the rise 100 multiplied by the circumference of the jacket 28.

It can also be appreciated that elevation of the outer jacket 28 means that space 24 is reduced by a volume about equal to the triangle extending all the way around the base 30. The reduction in space 24 gives rise to a savings in insulation material 25 required to fill the space 24. Another cost savings provided by the support base 30 of the present invention compared to prior art flat pans is that the base pan 30 does not extend across the entire bottom of the water tank 22, but instead is ring-shaped with a hole in the middle under the tank 22. The material savings in this regard are roughly equal to the surface area under the water tank 22.

Another advantage of the present invention is apparent from FIGS. 3 and 4. It is desirable to position the water tank 22 centrally within outer jacket 28 so that the water tank is supported to remain centered within the outer jacket 28 during the process of filling space 24 with foam. This is desirable because adequate and uniform insulation space is provided around an outer surface of water tank 22 without any inadequate or thin insulation spaces. This also means that the weight of the water tank 22 and the weight of the water tank 22 when filled with water, remains centered within outer jacket 28 and centered on the support base 30.

Figure 5:
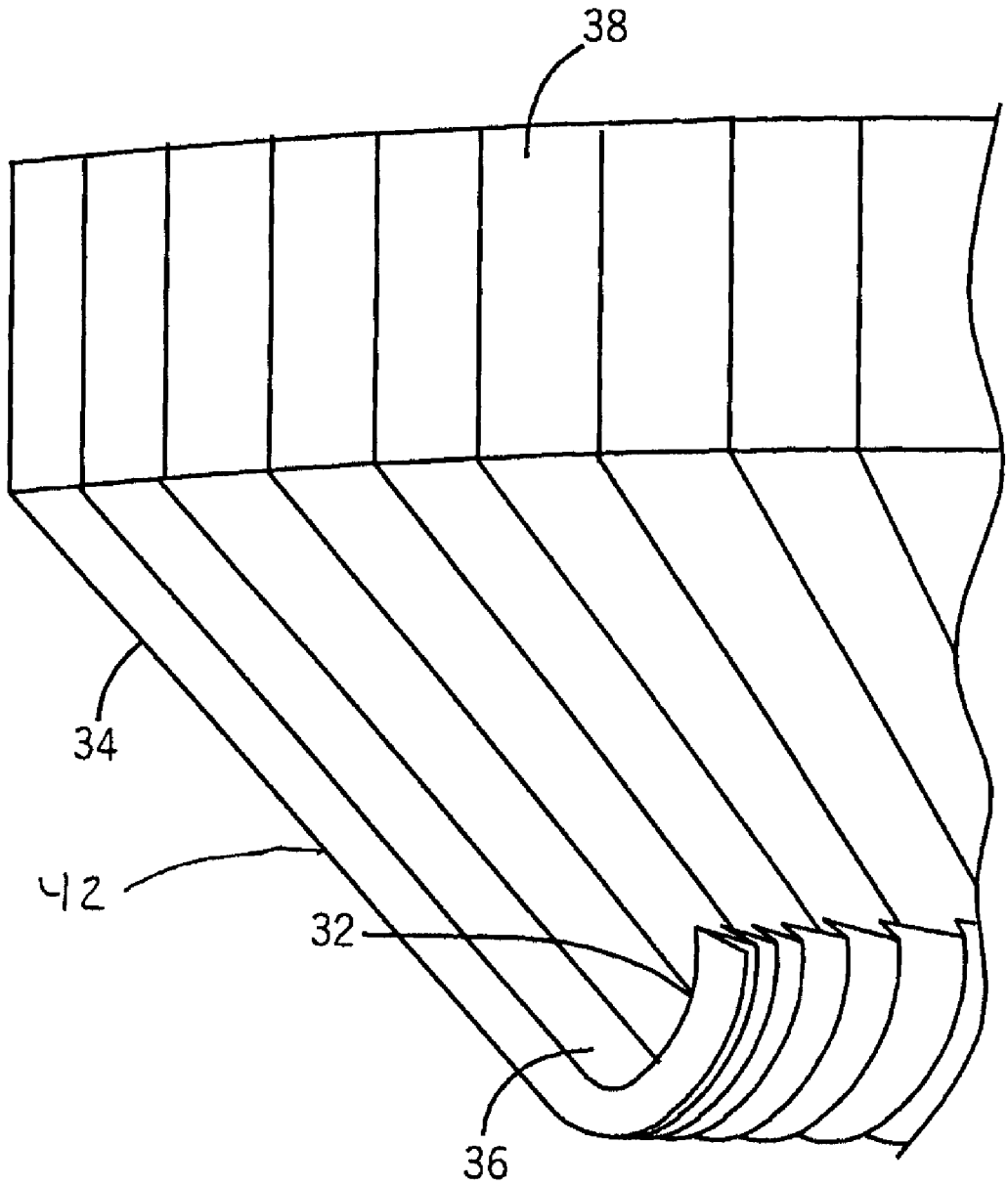
FIG. 5 is a partial elevation view of a portion of a support base formed with a corrugation construction.
Figure 6:
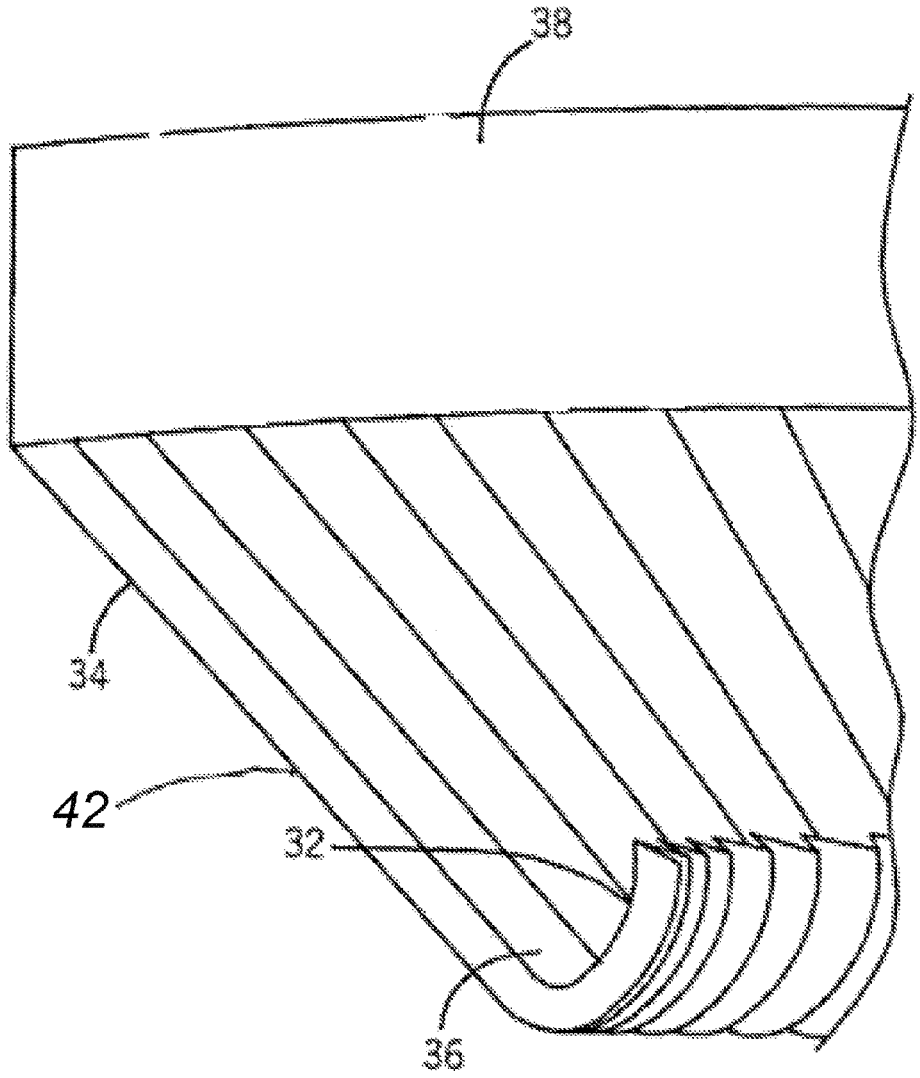
FIG. 6 is a partial elevation view of a portion of a support base formed with a corrugated construction with an upper portion that is formed without any corrugations.

Referring now to FIG. 5, an embodiment of the invention is shown that uses a specific construction method to form the support base 30. The support base in FIG. 5 is made with corrugations that provide structural rigidity. Additionally, the corrugated structure is relatively easy to manufacture. Corrugations ease the process of manufacturing because an initially flat strip of metal can be bent, shaped and formed with appropriate bends and angles to transform a flat strip of metal into a support base 30 with a lip 32, an angled middle portion 34 and a top portion 38. The corrugations take up the material along the inner radius (i.e., at the lip 32) of the base support 30, which is smaller than the outer radius (i.e., at the top portion 38). By properly spacing and sizing the corrugations, the radius of a strip of material can be adjusted such that when the two ends are joined together to form a circular band, the trough 36 circle has a diameter equal to the bottom edge of the water tank 22 it is intended to support.

Additional forms of construction may also be utilized to form the support base 30. For example, crimps may be utilized to transform a flat strip of metal into a curved, circular band that can be shaped into the proper construction to form the support base 30. Various other forms of manufacturing, forming and shaping will be apparent to those skilled in the art.

An alternate embodiment of the invention comprises a water heater support base being formed as an integral extension of the outer jacket. In this embodiment, the base is formed from the same material as the outer jacket and can be formed from the same sheet stock. In a profile view, the support base, the lip and the outer jacket will appear as a single part. The lip is formed as an extension of the outer jacket material. In this alternate embodiment, the outer jacket length is increased over the length shown in previous embodiments. However, since the support base is integral with the outer jacket, the result can be a net material savings. Additionally, manufacturing steps may be simplified.

Thus the invention provides, among other things, a water heater support base that positions and supports a water tank and an outer jacket to provide adequate and uniform insulation space around the water tank and such that the lower end of outer jacket is elevated vertically.

Various features and advantages of the invention are set forth in the following claims.

What is claimed is:

1. A method of making a circular support base for a water heater wherein:

a sheet of material having two ends and longitudinal edges extending between the two ends is formed with corrugations extending from one of the longitudinal edges toward the other longitudinal edge, such that the corrugations are progressively more pronounced towards one longitudinal edge thereby creating a generally circular shape out of the formerly straight sheet material;

the two ends are connected to form an unbroken circular shape;

the corrugated material is shaped to form a lip at an inner circumferential region; and the circular lip intersects with an outer circumferential region of the support base to form a circular trough for supporting and positioning a water tank of the water heater.

2. The method of claim 1 wherein the sheet has an upper region that is formed without any corrugations and the ends of the upper region are joined together to form an outer jacket.

3. The method of claim 1 wherein a top portion of the sheet extends upwardly from the outer circumferential region and is positioned above the outer circumferential region; and wherein the outer circumferential region is positioned between the lip and the top portion.

4. The method of claim 3 wherein the outer circumferential region is angled relative to the lip; and wherein the corrugations extend through the lip and through the outer circumferential region.

5. The method of claim 4 wherein the corrugations are angled relative to the longitudinal edge.

6. The method of claim 1 wherein the outer circumferential region is angled relative to the lip; and wherein the corrugations extend through the lip and through the outer circumferential region.

7. The method of claim 6 wherein the corrugations are angled relative to the longitudinal edge.

8. The method of claim 1 wherein the outer circumferential region is angled relative to the lip; and wherein the corrugations extend through the lip and through the outer circumferential region.

9. The method of claim 1 wherein the corrugations are angled relative to the longitudinal edge.

10. A method of making a support base for a water heater including a water storage tank, the method comprising:

providing a sheet of material including a left end, a right end, a top longitudinal edge extending between the left end and the right end, and a bottom longitudinal edge extending between the left end and the right end;

forming a plurality of corrugations in the sheet, each corrugation extending between the bottom longitudinal edge and the top longitudinal edge;

making a first bend in the sheet, the first bend positioned between the top longitudinal edge and the bottom longitudinal edge to form a lip between the first bend and the bottom longitudinal edge;

making a second bend in the sheet, the second bend positioned between the top longitudinal edge and the first bend to form a top portion between the second bend and the top longitudinal edge and a middle portion between the first bend and the second bend;

forming a curve in the sheet to bring the left end into contact with the right end; and connecting the left end to the right end to form a trough between the lip and the middle portion, the trough for receiving the water storage tank.

11. The method of claim 10, wherein making the first bend in the sheet includes forming a first interior angle of less than ninety degrees between the lip and the middle portion.

12. The method of claim 11, wherein making the second bend in the sheet includes forming a second interior angle of more than ninety degrees between the middle portion and the top portion.

13. The method of claim 10, wherein making the second bend in the sheet includes forming a second interior angle of more than ninety degrees between the middle portion and the top portion.

14. The method of claim 10, wherein forming a plurality of corrugations includes making each corrugation more pronounced near the bottom longitudinal edge than near the top longitudinal edge.

15. The method of claim 10, wherein forming a plurality of corrugations includes creating a series of alternating peaks and valleys having a height, the height near the bottom longitudinal edge greater than the height near the top longitudinal edge.

16. The method of claim 10, wherein making a second bend in the sheet includes defining a support surface at the intersection of the top portion and the middle portion, the support surface being configured to receive and support a bottom edge of a jacket surrounding the water storage tank such that the jacket is elevated from a floor on which the support base sits.

17. The method of claim 10, wherein forming a plurality of corrugations includes taking up material of the sheet along the bottom longitudinal edge at a greater rate than at the top longitudinal edge.

* * * * *